US005794700A

United States Patent [19]

Pollack

[11] Patent Number: 5,794,700

[45] Date of Patent: Aug. 18, 1998

[54] CAM FLUID TRANSFER SYSTEM

[75] Inventor: Jack Pollack, Calabasas Hills, Calif.

[73] Assignee: Imodco, Inc., Calabasas Hills, Calif.

[21] Appl. No.: 789,705

[22] Filed: Jan. 27, 1997

[51] Int. Cl.[6] ..... E21B 7/12; E21B 33/038

[52] U.S. Cl. ..... 166/339; 166/345; 166/355; 166/359; 166/366; 405/224

[58] Field of Search ..... 166/339, 345, 166/355, 359, 365, 366; 405/224, 224.2, 223.1

[56] References Cited

U.S. PATENT DOCUMENTS

| | | | |
|---|---|---|---|
| 3,111,692 | 11/1963 | Cox | 166/365 X |
| 3,602,175 | 8/1971 | Morgan et al. | 405/224.2 X |
| 3,791,442 | 2/1974 | Watkins | 166/355 X |
| 4,362,215 | 12/1982 | Sparks | 166/345 X |
| 4,397,357 | 8/1983 | Hettinger | 166/345 |
| 4,436,451 | 3/1984 | Anderson | 166/355 X |
| 4,576,516 | 3/1986 | Denison | 405/195 |
| 4,668,126 | 5/1987 | Burton | 166/345 X |
| 4,708,178 | 11/1987 | Pollack et al. | 141/279 |
| 5,046,896 | 9/1991 | Cole | 405/224 X |

FOREIGN PATENT DOCUMENTS

| | | |
|---|---|---|
| 994040 | 6/1965 | United Kingdom . |
| 1312544 | 4/1973 | United Kingdom . |
| WO 96/36528 | 11/1996 | WIPO . |

*Primary Examiner*—George A. Suchfield
*Attorney, Agent, or Firm*—Freilich Hornbaker Rosen

[57] ABSTRACT

An offshore fluid transfer system (10) is provided, of the type that includes a riser (32) having an upper end (34) connected through a universal joint (36) to a turret (22) on a vessel and having a lower end (36) anchored by catenary chains (40), and that also includes hoses (70, 71) extending from a base (50, 58) on the seafloor to the turret on the vessel, which avoids the need for a complicated hose structure to pass fluid across the universal joint. A fluid coupling (73) near the bottom of the turret, which is widely spaced from the universal joint, connects to a hose that extends from the fluid coupling in a sinuous path down to the seafloor base. The long length of hose, enables it to bend when the vessel drifts, to avoid excessive hose tension or riser contact during such vessel drift. A riser connector (102) can be operated to disconnect the riser from the turret so the riser can sink. The fluid coupling can include a fluid connector (100) which can separately disconnect the hose from the turret. A ring-shaped holder (80) connected to the hose lies around the axis of the turret and around the riser.

8 Claims, 3 Drawing Sheets

CAM FLUID TRANSFER SYSTEM

BACKGROUND OF THE INVENTION

One type of offshore system includes a vessel that can weathervane about a turret, with the turret moored through a riser that extends down to near the seafloor and which is anchored thereat to the seafloor. Chains are usually used to anchor the riser, and such system is commonly referred to as a CAM (chain articulated mooring). The upper end of the riser is connected to the turret through a universal joint (a joint that permits pivoting about two horizontal axes) to permit the riser to tilt as the vessel drifts away from its quiescent position. In most installations, fluid must be transferred between hydrocarbon wells or a pipeline at the seafloor, to the vessel. This has been previously accomplished by a hose extending from a base on the seafloor to the lower end of a pipe lying within the riser and extending up through the riser. A short length of hose connects the upper end of the pipe lying in the riser to a pipe on the turret. U.S. Pat. No. 4,637,335 shows arrangement of this type.

In certain weather, the vessel may drift considerably from its quiescent position, resulting in the riser tilting considerably from the vertical. The universal joint permits this without problems. However, such pivoting results in a hose extending from the top of the riser to a pipe on the turret, undergoing considerable bending. Such hoses are commonly of large diameters to accommodate several smaller hoses within an outer hose sheath, and cannot readily bend to a small radius of curvature, especially where it is subjected to repeated bending and unbending. U.S. Pat. No. 4,708,178 describes a mechanism for transferring fluid across the space occupied by a universal joint, which minimizes bending of a relatively short length of hose (e.g. a hose length less than one hundred times its diameter). However, such mechanism is cumbersome and subject to failure. A fluid conduit arrangement that was simple and reliable, for use in an offshore system where a riser extends from a vessel turret to near the seafloor, would be of value.

SUMMARY OF THE INVENTION

In accordance with one embodiment of the present invention, an offshore fluid transfer system is provided, of the type that includes a largely vertical riser with an upper end connected through a universal joint to a turret on a vessel, which has a relatively simple and reliable hose arrangement. A fluid coupling lies on the turret, at a location that is at least horizontally spaced from the universal joint, and a flexible hose extends from the fluid coupling to seafloor base. The hose is free of attachment to the riser. As a result, tilting of the riser and of the hose is independent, but with the hose constructed so it avoids interference with the riser under all design weather conditions. The long hose, whose length is much greater than one hundred times its average outside diameter, undergoes only large radius of curvature bending, so it has a long lifetime of use.

The riser can be made to be disconnectable, so that when an iceberg or very heavy weather closely approaches, the upper end of the riser can be disconnected from the universal joint to sink to a predetermined underwater depth. The fluid coupling that connects the upper end of the hose to the turret, also can be constructed to disconnect so the hose can float free to an underwater depth, with a ring at the top of the hose supporting it at a predetermined underwater depth. The hose and riser are separately disconnectable. As a result, when danger approaches but is still several hours away, the hose can be worked on and disconnected, since it takes several hours for this. Only when the danger is very close, is the riser disconnected, as this takes only several minutes. If the potential danger bypasses the system, after the hose arrangement has been disconnected but the riser remains connected, the vessel will have remained moored so it takes only a mode rate period of time to reattach the hose.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
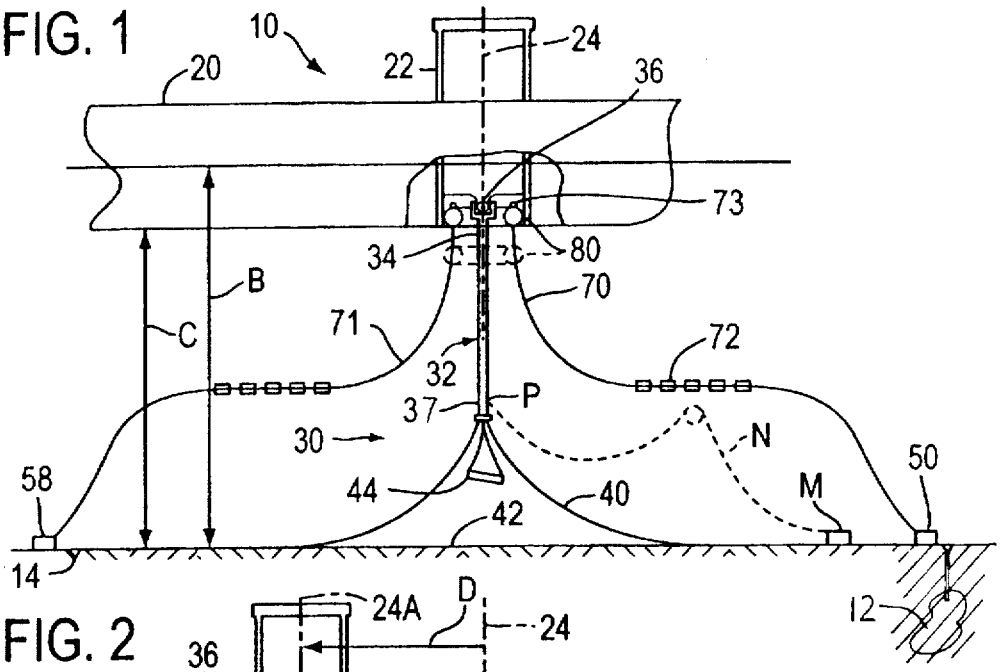
FIG. 1 is a simplified side elevation view, partially in section, of an offshore fluid transfer system of a first embodiment of the invention, with the vessel in a quiescent position.

FIG. 1 illustrates an offshore fluid transfer system 10 which is useful to produce hydrocarbons from undersea wells such as 12, 14. The system includes a vessel 20, with a turret 22 lying in a moonpool in the vessel (a turret can otherwise lie outboard of the vessel). The vessel is rotatable without limit about the turret axis 24, with changing winds and currents. The vessel is moored through a mooring arrangement 30 connected to the turret, which includes a riser 32. The riser has an upper end 34 connected by a universal joint 36 to the turret, to permit riser pivoting about two perpendicular horizontal axes. The riser has a lower end 37 which is coupled through catenary chains 40 to the seafloor 42. In the particular installation shown, the sea depth B is 90 meters and the vessel bottom height C is 75 meters above the seafloor. A weight 44 hangs from a chain table at the lower end of the riser, so the riser acts like a pendulum that stores energy when the vessel drifts, and that limits the depth of submersion of the riser when it is detached from the vessel. This type of system is known, and is described in my earlier U.S. Pat. Nos. 4,637,335, 4,645,467, 4,802,431, and 5,025,743. FIG. 1 shows the riser in a quiescent position wherein the riser extends substantially vertically (an incline of less than 5° from the vertical).

Figure 4:
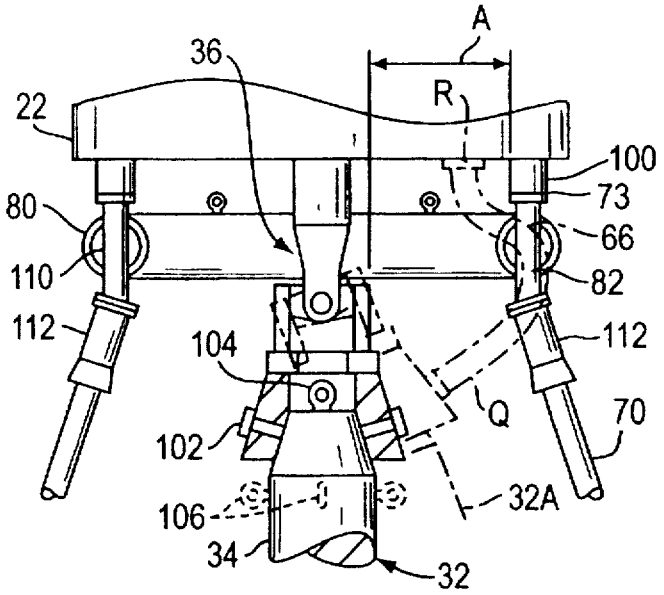
FIG. 4 is a partially sectional view of a portion of the system of FIG. 1, showing riser and fluid connectors.

Seafloor bases 50, 58 are connected to the wells 12, 14 (and other wells) and each seafloor base is connected through a hose or hose arrangement 70, 71 to the turret 22. In the prior art, a seafloor base such as M was connected to the turret through a hose arrangement N whose end opposite the base was connected to a location P lying near the lower end of the riser. Pipes extending upwardly through the riser connected the fluid conduits to pipes on the turret. However, a fluid joint arrangement was required to bypass the universal joint 36. FIG. 4 shows, in phantom lines, one example of a prior art fluid joint arrangement which was formed by a bridging hose Q (shown with the riser tilted to 32A) having a lower hose end connected to the upper end 34 of the riser and having an upper hose end connected to the turret 22. Since the upper end 34 of the riser lies close to the height of the turret, a bridging hose Q of only limited length could be used. This resulted in large bending of the hose when the riser tilted. As described in U.S. Pat. No. 4,708,178, such large repeated hose bending for a bridging hose of limited length (less than one hundred times its width) resulted in a reduced bridging hose life, especially where the bridging hose carries high pressure fluids that tends to affect hose bending. Also, steps had to be taken to protect the highly bent hose from damage. Although the above U.S. Pat. No. 4,708,178 describes an alternative fluid joint arrangement, that arrangement has been cumbersome and not highly reliable.

In accordance with the present invention, applicant constructs the hose member or hose 70 for considerable hose bending when the vessel drifts, by constructing the hose so it extends from the base 50 to the turret 22 without contact with the riser 32. Instead, the hose extends from a fluid coupling 73 on the turret, with the coupling 73 spaced a considerable distance A from the universal joint 36. The hose extends in a curved path to the seafloor base 50, without contacting the riser. Floats 72 (FIG. 1) control the shape of the hose.

Figure 2:
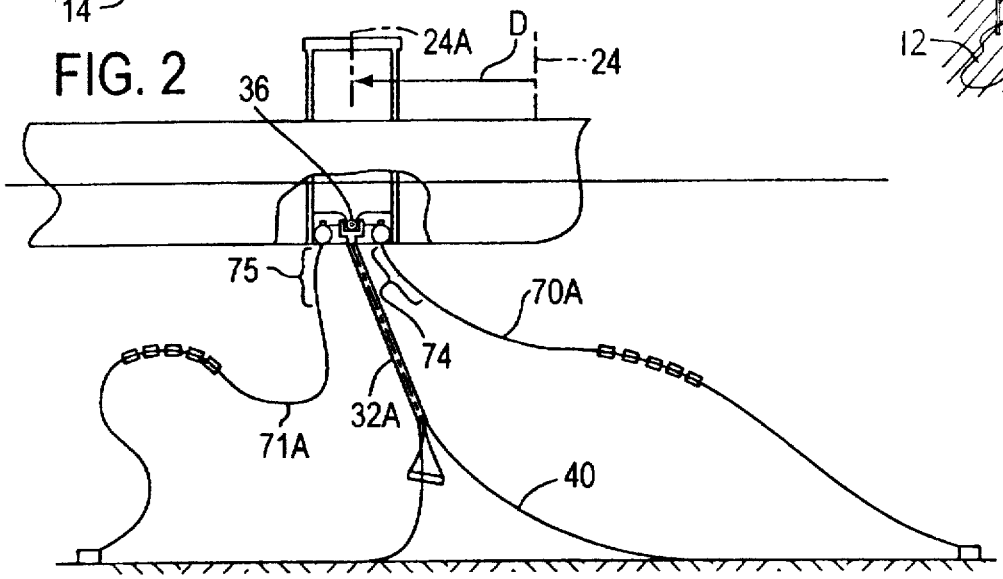
FIG. 2 is a view similar to that of FIG. 1, wherein the vessel has drifted far from its quiescent position.

FIG. 2 shows the system when there is a strong wind and/or current that urges the vessel to drift a considerable distance D so its axis 24 moves to the drifted position 24A. The riser has tilted at the universal joint 36 to the tilted position 32A, with those chains extending away from the drift direction being picked up off the seafloor. With the riser tilted to 32A, the hose at 70A does not beat against the riser, because the hose 70A has straightened, resulting in the upper ten percent 74 of the hose length extending at a greater angle to the vertical than in the quiescent position, and therefore tilting in largely the same manner as the riser. The other hose arrangement or hose 71A has an upper ten percent of length 75 that extends more towards the vertical and is even further away from contact with the riser. Contact with the riser is undesirable, as it can damage the hose. The length of the hose is preferably between 1.2 times and 3 times the height C of the hull bottom above the seafloor, to obtain about the same increase in tilt of the hose upper end as the riser.

Figure 3:
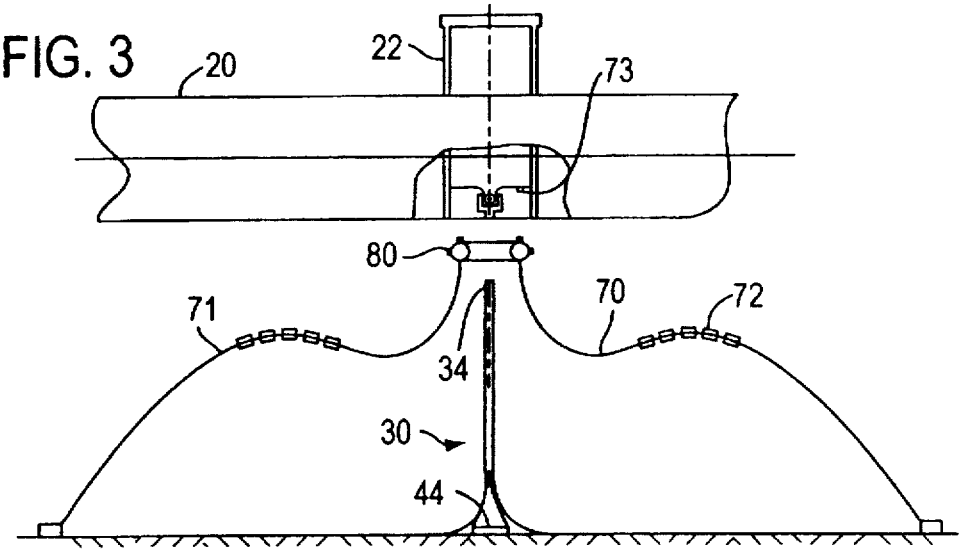
FIG. 3 is a view similar to that of FIG. 1, but wherein both the riser and hose arrangement have been disconnected from the vessel turret.

FIG. 3 shows the riser upper end 34 and the hose 70, each disconnected from the turret 22. The riser falls to a predetermined depth, wherein its weight 44 rests on the seafloor. The upper end of the hoses 70, 71 are mounted on a ring holder 80 that is buoyant. The ring 80 sinks to a predetermined depth, determined by the weight of the hoses such as 70 and the buoyancy of the floats 72 and of the ring holder 80. FIG. 1 shows the holder 80 in its connected position and, in phantom lines in its disconnected and lowered position while lying around the still connected riser.

If danger approaches the system, such as an iceberg or severe weather condition, and the vessel 20 must be moved away from the sea location, both of the hoses 70, 71 and the mooring arrangement 30 must be disconnected from the vessel. Previously, the mooring arrangement and hoses were connected together and were detached together from the vessel. However, applicant has considered the fact that many approaching potential dangers do not actually reach the site of the offshore fluid transfer system. A determination as to whether or not the danger will reach the site, becomes known only at later times, when there is less time to act. It requires perhaps four hours to properly disconnect the hoses 70, 71 and the turret. This period is required to provide time to shut in the wells, rotate isolation valves, isolate disconnected flow line connectors, and purge subsea lines. A winch is used to gradually lower the ring holder 80 on which the hose upper ends 82 are mounted. Disconnection of the riser from the turret requires only about ten minutes, during which the upper end of the riser is disconnected from the universal joint and the riser is slowly winched down until its weight rests on the seafloor.

So long as the riser is connected to the turret by the universal joint 36, the vessel is held in position, and it is a relatively simple matter to pull up the ring holder 80 and reconnect the hose upper ends 82 to the fluid couplings 73 on the turret. However, if the riser is disconnected, then the vessel is likely to drift away from a position above the riser. In that case, a time consuming process must be followed, where personnel on the vessel may pick up floats at the top of messenger lines, attach one or more cables to pad eye(s) 104 on the riser, and slowly raise the riser (including its heavy counter weight 44) to the universal joint, where connections are made.

When an iceberg, severe weather, or other danger approaches the site, so it may reach the site within perhaps four hours, applicant prefers to start disconnection of the hose arrangement, so that if the danger persists, steps can be taken to disconnect the hose upper ends 82 (and possibly purge the entire hose) so the disconnection can be completed perhaps thirty minutes before the danger will arrive. If the danger still persists, then steps are taken to disconnect the riser and it is lowered to the seafloor. In many cases, personnel can determine that the danger will not arrive at the site, and if this occurs before the riser has been disconnected from the universal joint, then the vessel has not drifted away from the riser, and reconnection of the riser and hoses can occur in perhaps several hours, instead of several days.

FIG. 4 shows details of the upper ends of the riser and hoses. Fluid connectors 100, which may be operated hydraulically, electrically, etc., can disconnect the fluid couplings 73 from the turret. Winch lines connected to pad eyes on the ring holder 80 can lower it and the upper ends 82, 110 of the hoses. The holder 80 continues to be located around the riser 34 for easy pull up, so long as the riser is not disconnected. The riser can be disconnected by a set of riser connectors 102 which also can be operated hydraulically, electrically, etc. A winch or the like for gradually lowering the riser 34 or pulling it back up, can be connected to a large pad eye 104, or to a group of pad eyes 106 on the riser. It is noted that the hose 70 can include rigid parts such as a rigid pipe at 82 and a bend restrictor 112, although the hose 70 include flexible hose sections extending along more than half of the total hose length.

Figure 5:
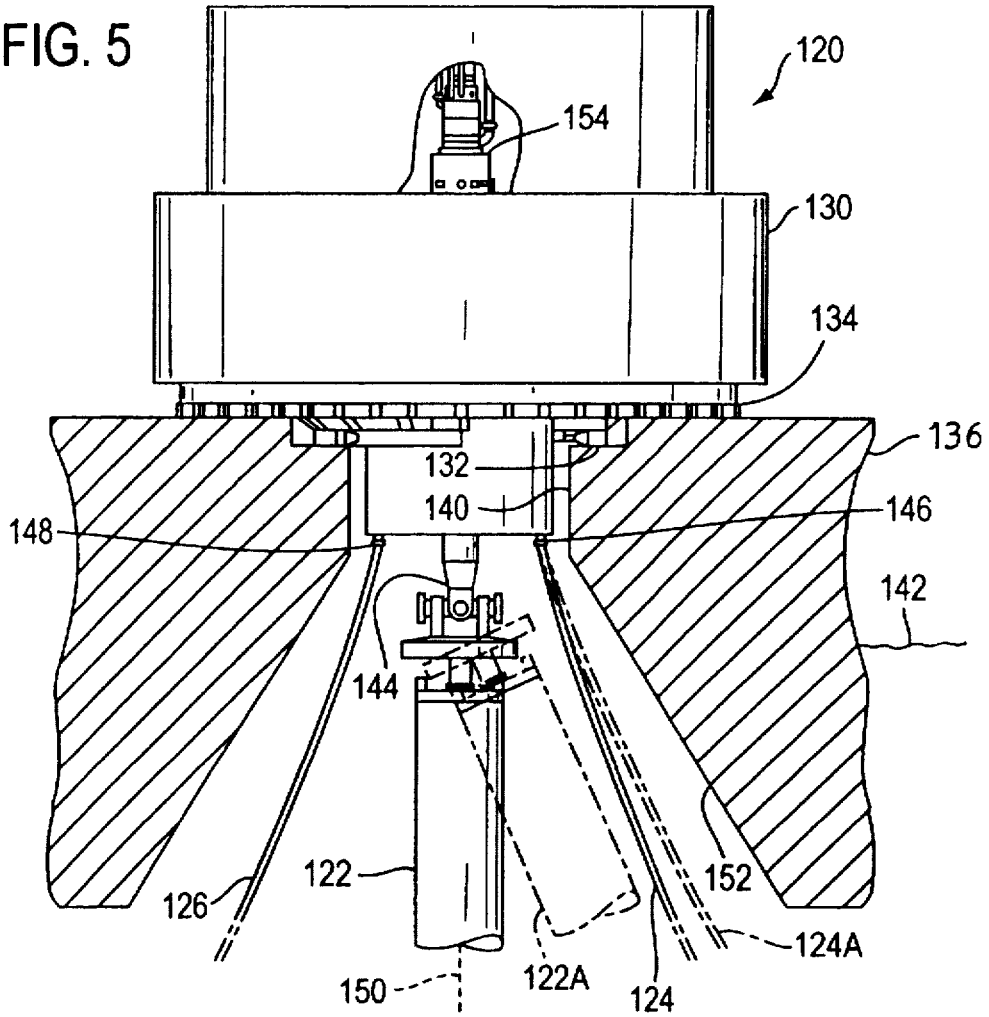
FIG. 5 is a partial sectional view of an offshore fluid transfer system constructed in accordance with another embodiment of the invention, wherein the riser and hose arrangement are not readily disconnectable.

FIG. 5 illustrates a portion of an offshore fluid transfer system 120 of another embodiment of the invention, wherein the riser 122 and hoses 124, 126 are not disconnectable from the turret 130. The turret is mounted on thrust and radial bearings 132, 134 on a vessel hull 136 and lies within a moonpool 140 in the hull. The sea surface is shown at 142 where the vessel is about fifty percent loaded. A universal joint 144 for connecting the turret to the riser, and fluid couplings 146 for connecting the hoses to the turret, can be located above the sea surface under all but nearly fully loaded conditions of the vessel. It is noted that the fluid couplings 146, 148 are widely horizontally spaced from the universal joint 144 and extend at inclines away from the vertical, so the hoses extend progressively away from the axis 150 of the riser. If the riser should tilt to the position 122A, the hose 124 will be pulled to assume the position 124A, to still avoid contact with the riser. The moonpool 140 includes a tapered lower portion 152 which allows the riser and hose arrangements to tilt without interference from the hull, up to the maximum design tilt (e.g. 30°) of the system. It is noted that a stack of fluid swivels 154 is usually provided to distribute fluids passing up and/or down through the hoses, which each may include several smaller hoses.

Figure 6:
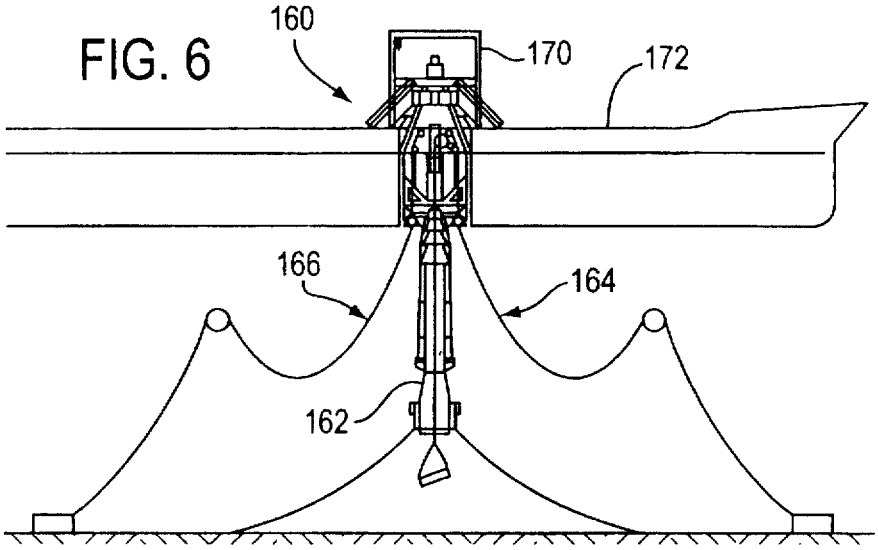
FIG. 6 is a partially sectional side view of an offshore fluid transfer system constructed in accordance with another embodiment of the invention, shown in its quiescent position and with the hose and riser connected to the vessel.
Figure 7:
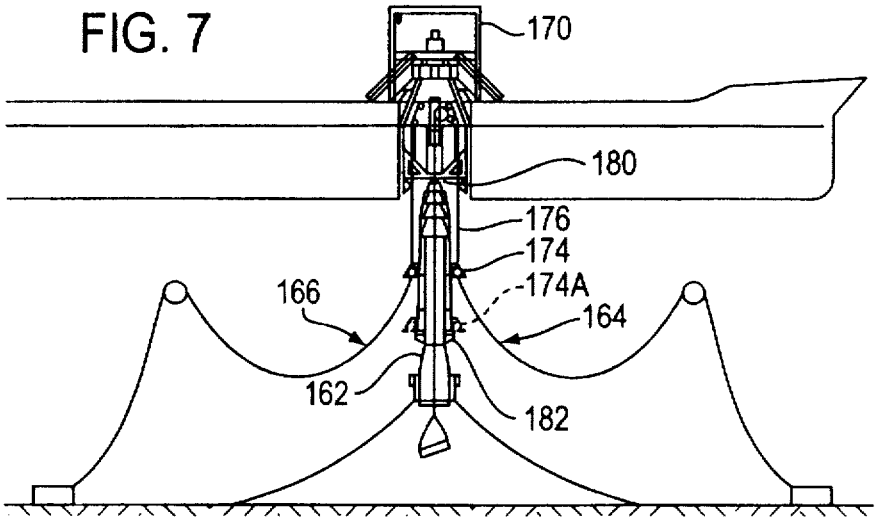
FIG. 7 is a view similar to that of FIG. 6, but with the upper end of the hose disconnected from the vessel turret and partially lowered.

FIG. 6 illustrates a system 160 of another embodiment of the invention, wherein a riser 162 and hoses 164, 166 are detachable from a turret 170 mounted on a vessel 172. FIG. 7 shows a ring holder 174 at the upper ends of the hoses, after the ring holder has been disconnected from the turret and is in the process of being lowered by winch lines 176. The riser 162 continues to be connected through a universal joint 180 to the turret.

The riser has a stop 182 positioned far below its top, on which the holder ring 174 can rest, when the ring is fully lowered to the position 174A.

Figure 8:
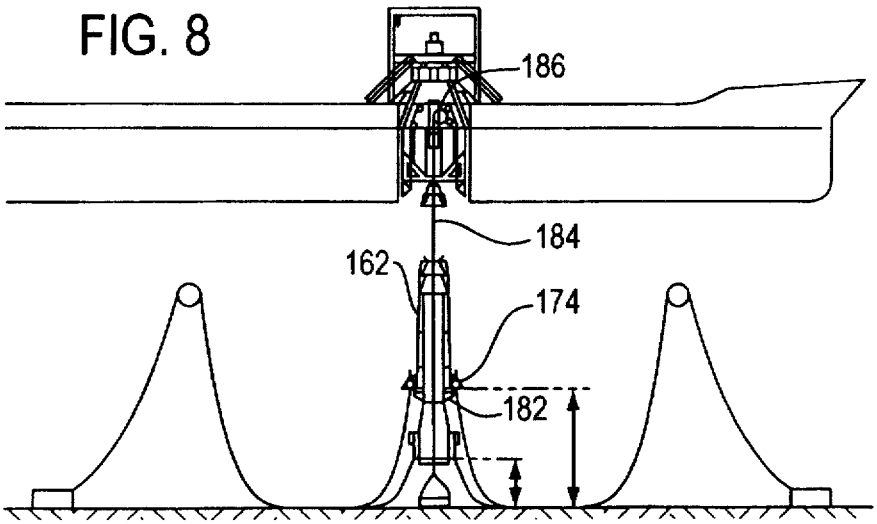
FIG. 8 is a view similar to that of FIG. 6, with both the hose arrangement and riser disconnected from the vessel, and with only a lowering line connecting the riser to the vessel.

FIG. 8 shows the system wherein the ring at 174A has been fully lowered onto the stop 182, and where a lowering line 184 extending from a winch 186, is lowering the riser 162 to the seafloor. After the riser 162 has been fully lowered, the turret is disconnected from the riser and the vessel can sail away.

So long as the system is in the condition of FIG. 7, wherein the riser 162 is connected through the universal joint 186 to the turret 170, the vessel continues to be securely moored. Even though the hoses 164, 166 have been disconnected, reconnection can be accomplished in several hours. As discussed above, if an approaching danger passes by and recedes from the location, such reconnection can be readily accomplished. The lowering of the riser shown in FIG. 8 takes only several minutes, and can be accomplished "at the last moment", such as when an iceberg continues to approach the station and is only several hundred meters away. The apparatus for connecting the riser and hose arrangements can be similar to those of FIG. 4.

Thus, the invention provides an offshore fluid transfer system of the type that includes a primarily vertical riser with an upper end connected through a universal joint to a turret on a vessel, and one or more hoses for passing fluid between a sea base and the vessel, which avoids the need for a fluid coupling to pass across the universal joint from the riser. The upper end of each hose is connected to a fluid coupling that is mounted on the turret and that is at least horizontally spaced from the universal joint. A majority of the length of the upper half of the hose is flexible, and preferably almost all (over 80%) of the length of the hose is flexible, so when the vessel drifts and the riser tilts, the hose bends about long radii of curvature and avoids contact with the riser. The upper end of the hose can be connected to a ring holder that is disconnectable from the turret. The ring holder can comprise a buoy that allows the ring to float to a predetermined underwater depth. In another arrangement the riser has a stop and the ring holder can be lowered around the riser until the ring holder lies on the stop of the riser and is supported thereat.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore fluid transfer system which includes a vessel, a turret mounted on said vessel to enable vessel rotation about a largely vertical axis about the turret, and a mooring arrangement that includes a riser having an upper end connected by a universal joint to said turret to permit said riser upper end to pivot about two largely horizontal axes with respect to said turret, said riser having a lower end anchored to the seafloor for transferring fluid between a seafloor base and said turret, comprising:

a fluid coupling mounted on said turret at a location which is spaced from said universal joint;

a hose extending from said fluid coupling to said seafloor base, with said hose being free of connection to said riser.

2. The system described in claim 1 wherein:

said vessel has a quiescent position wherein said riser extends substantially vertically, and said hose is of a length between 1.2 and three times the distance between the bottom of said turret and the seafloor, whereby the tilt of the hose upper end increases with increasing riser tilt from the vertical, as the vessel drifts.

3. The system described in claim 1 including:

a riser connector which is operable to disconnect said riser from said turret, said riser being constructed to sink to a predetermined depth when disconnected from said turret;

said fluid coupling includes a connector which is operable to disconnect said hose independently of operation of said riser connector, said hose being constructed to lie at a predetermined depth when disconnected from said turret, whereby to enable disconnection of said hose while leaving said riser connected.

4. The system described in claim 1 including:

a riser connector which is operable to disconnect said riser from said turret, said riser being constructed to sink to a predetermined depth when disconnected from said turret;

said fluid coupling includes a connector which is operable to disconnect said hose independently of operation of said riser connector;

a ring holder which extends around said axis and which is of larger inside diameter than said riser upper end, said hose having an upper end connected to said ring holder, whereby when said hose is disconnected, said ring holder can lie around said riser.

5. The system described in claim 4 wherein:

said riser has a stop that is positioned to stop the decent of said ring holder so said ring holder is held at the height of said stop when said hose is disconnected and said ring holder is free to descend.

6. The system described in claim 4 wherein:

said ring holder is buoyant and constructed to lie at a predetermined underwater level when loaded by said hose.

7. An offshore fluid transfer system which includes a vessel that floats at the sea surface, a mooring arrangement which has an upper end connected to the vessel and a lower end anchored to the seafloor, and a fluid hose arrangement that includes a hose extending from a base at the sea, wherein:

said mooring arrangement includes a riser extending along a vertical axis down from said vessel, said riser having an upper end that is detachably connected to said vessel;

said hose arrangement includes a ring-shaped holder that has a larger inside diameter than said riser upper end, said holder extending around said axis, with said hose having an upper end attached to said holder;

said holder and said riser each being completely detachable from said vessel to allow said vessel to move away from the vicinity of the sea surface that lies above said sea base if a dangerous condition approaches said vicinity which could damage said vessel;

said holder being detachable from said vessel independently of said riser so said holder can be detached as the dangerous condition approaches while leaving the riser attached in case the danger is found to not reach the vessel.

8. The system described in claim 7 wherein:

said ring-shaped holder has a vertical axis and said hose arrangement includes a plurality of hose members, including said hose, said hose members having upper hose ends connected to said ring-shaped holder at locations spaced about said axis, and said hose members having lower hose ends coupled to locations on the seafloor that are spaced about said axis;

said ring-shaped holder being buoyant to hold itself and at least part of the lengths of said hoses above the seafloor when said ring-shaped holder is detached from said vessel.

* * * * *